US011624366B1

(12) United States Patent
Ignatiev et al.

(10) Patent No.: US 11,624,366 B1
(45) Date of Patent: Apr. 11, 2023

(54) CO-ROTATING SCROLL COMPRESSOR HAVING FIRST AND SECOND OLDHAM COUPLINGS

(71) Applicant: Emerson Climate Technologies, Inc., Sidney, OH (US)

(72) Inventors: Kirill M. Ignatiev, Sidney, OH (US); Mikhail A. Antimonov, Beavercreek, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 17/519,876

(22) Filed: Nov. 5, 2021

(51) Int. Cl.
*F03C 2/00* (2006.01)
*F03C 4/00* (2006.01)
(Continued)

(52) U.S. Cl.
CPC ..... *F04C 29/0057* (2013.01); *F01C 17/066* (2013.01); *F04C 18/023* (2013.01); *F04C 23/008* (2013.01); *F04C 2240/52* (2013.01)

(58) Field of Classification Search
CPC ..... F04C 18/023; F04C 18/0238; F04C 18/0207; F04C 29/005; F04C 29/0057; F04C 29/045; F04C 23/008; F04C 2240/30; F04C 2240/50; F04C 2240/52; F01C 1/0207; F01C 1/023; F01C 1/067; F01C 17/06; F01C 17/066
See application file for complete search history.

(56) References Cited

U.S. PATENT DOCUMENTS 2,415,011 A 1/1947 Hubacker
2,420,124 A 5/1947 Coulson
(Continued)

FOREIGN PATENT DOCUMENTS

CN 101080597 A 11/2007
CN 101682226 A 3/2010
(Continued)

OTHER PUBLICATIONS

JP07259760A—Taniwa et al.—Corotating Scroll Compressor—Oct. 9, 1995—the Machine English Translation (Year: 1995).*
(Continued)

*Primary Examiner* — Theresa Trieu
(74) *Attorney, Agent, or Firm* — Harness, Dickey & Pierce, P.L.C.

(57) ABSTRACT

A compressor may include first and second scroll members, a driveshaft, first and second bearings, and first and second Oldham couplings. The scroll members define compression pockets. The first bearing may define a first rotational axis about which the first scroll member rotates. The second bearing may support the second scroll member for rotation about a second rotational axis that is offset from the first rotational axis. The first Oldham coupling may include a first body and a plurality of first keys extending from the first body. The first keys may engage slots formed in the second scroll member. The second Oldham coupling is separate and distinct from the first Oldham coupling. The second Oldham coupling may include a second body and a plurality of second keys extending from the second body. The second keys may engage slots formed in a surface that rotates about the first rotational axis.

20 Claims, 13 Drawing Sheets

(51) Int. Cl.

| | |
|---|---|
| ***F04C 2/00*** | (2006.01) |
| ***F04C 18/00*** | (2006.01) |
| ***F04C 29/00*** | (2006.01) |
| ***F04C 18/02*** | (2006.01) |
| ***F01C 17/06*** | (2006.01) |
| *F04C 23/00* | (2006.01) |

(56) References Cited

U.S. PATENT DOCUMENTS

| | | | | |
|---|---|---|---|---|
| 2,440,593 | A | 4/1948 | Miller | |
| 3,817,664 | A | 6/1974 | Bennett et al. | |
| 4,105,374 | A | 8/1978 | Scharf | |
| 4,753,582 | A | 6/1988 | Morishita et al. | |
| 4,781,550 | A | 11/1988 | Morishita et al. | |
| 4,846,639 | A | 7/1989 | Morishita et al. | |
| 4,927,339 | A | 5/1990 | Riffe et al. | |
| 4,927,340 | A | 5/1990 | McCullough | |
| 4,950,135 | A | 8/1990 | Tojo et al. | |
| 5,002,470 | A | 3/1991 | Gormley et al. | |
| 5,037,280 | A | 8/1991 | Nishida et al. | |
| 5,051,075 | A | 9/1991 | Young | |
| 5,069,605 | A | 12/1991 | Saitoh et al. | |
| 5,073,093 | A | 12/1991 | Takagi et al. | |
| 5,082,432 | A | 1/1992 | Kikuchi | |
| 5,090,876 | A | 2/1992 | Hashizume et al. | |
| 5,099,658 | A | 3/1992 | Utter et al. | |
| 5,123,818 | A | 6/1992 | Gormley et al. | |
| 5,129,798 | A | 7/1992 | Crum et al. | |
| 5,141,417 | A * | 8/1992 | Bush | F01C 17/066 418/55.3 |
| 5,141,421 | A | 8/1992 | Rush et al. | |
| 5,142,885 | A | 9/1992 | Utter et al. | |
| 5,149,255 | A | 9/1992 | Young | |
| 5,178,526 | A | 1/1993 | Galante et al. | |
| 5,199,280 | A | 4/1993 | Riffe et al. | |
| 5,211,031 | A | 5/1993 | Murayama et al. | |
| 5,242,284 | A | 9/1993 | Mitsunaga et al. | |
| 5,256,042 | A | 10/1993 | McCullough et al. | |
| 5,256,044 | A | 10/1993 | Nieter et al. | |
| 5,263,822 | A | 11/1993 | Fujio | |
| 5,277,563 | A | 1/1994 | Wen-Jen et al. | |
| 5,314,316 | A | 5/1994 | Shibamoto et al. | |
| 5,328,341 | A | 7/1994 | Forni | |
| 5,421,709 | A | 6/1995 | Hill et al. | |
| 5,449,279 | A | 9/1995 | Hill et al. | |
| 5,490,769 | A | 2/1996 | Calhoun | |
| 5,609,478 | A * | 3/1997 | Utter | F04C 29/0057 418/55.6 |
| 5,713,731 | A | 2/1998 | Utter et al. | |
| 5,791,883 | A | 8/1998 | Ban et al. | |
| 6,359,357 | B1 | 3/2002 | Blumenstock | |
| 6,616,430 | B2 | 9/2003 | Mori et al. | |
| 6,692,205 | B2 | 2/2004 | Moroi et al. | |
| 6,712,589 | B2 | 3/2004 | Mori et al. | |
| 6,776,593 | B1 | 8/2004 | Cho | |
| 6,993,910 | B2 | 2/2006 | Iwanami et al. | |
| 7,201,567 | B2 | 4/2007 | Wiertz et al. | |
| 7,344,367 | B2 | 3/2008 | Manole | |
| 8,007,260 | B2 | 8/2011 | Yanagisawa | |
| 8,058,762 | B2 | 11/2011 | Asano | |
| 8,179,016 | B2 | 5/2012 | Asano | |
| 8,323,006 | B2 | 12/2012 | Schofield et al. | |
| 8,373,326 | B2 | 2/2013 | Enomoto et al. | |
| 8,894,388 | B2 | 11/2014 | Lee et al. | |
| 9,169,841 | B2 | 10/2015 | Bonnefoi et al. | |
| 9,534,599 | B2 | 1/2017 | Rosson et al. | |
| 9,719,510 | B2 | 8/2017 | Fujioka et al. | |
| 10,215,174 | B2 | 2/2019 | Stover et al. | |
| 10,280,922 | B2 | 5/2019 | Doepker et al. | |
| 10,400,770 | B2 | 9/2019 | Fullenkamp et al. | |
| 10,415,567 | B2 | 9/2019 | Doepker et al. | |
| 10,465,954 | B2 | 11/2019 | Doepker et al. | |
| 10,718,330 | B2 | 7/2020 | Stover et al. | |
| 10,995,754 | B2 | 5/2021 | Doepker et al. | |
| 11,041,494 | B2 | 6/2021 | Hirata et al. | |
| 2002/0182094 | A1 | 12/2002 | Mori et al. | |
| 2005/0031465 | A1 | 2/2005 | Dreiman et al. | |
| 2005/0201884 | A1 | 9/2005 | Dreiman | |
| 2008/0087033 | A1 | 4/2008 | Bae et al. | |
| 2008/0240957 | A1 * | 10/2008 | Yanagisawa | F01C 17/066 418/55.3 |
| 2009/0104060 | A1 | 4/2009 | Sato et al. | |
| 2010/0164313 | A1 | 7/2010 | Langford et al. | |
| 2010/0225195 | A1 | 9/2010 | Asano et al. | |
| 2011/0002797 | A1 | 1/2011 | Takeuchi et al. | |
| 2011/0038737 | A1 | 2/2011 | Conry et al. | |
| 2012/0131945 | A1 | 5/2012 | Huang et al. | |
| 2012/0171060 | A1 | 7/2012 | Shin et al. | |
| 2013/0036762 | A1 | 2/2013 | Shaffer et al. | |
| 2013/0181565 | A1 | 7/2013 | Petro et al. | |
| 2014/0361651 | A1 | 12/2014 | Park et al. | |
| 2016/0043602 | A1 | 2/2016 | Hosek et al. | |
| 2016/0123147 | A1 | 5/2016 | Fujioka et al. | |
| 2017/0051741 | A1 | 2/2017 | Shaffer et al. | |
| 2018/0013336 | A1 | 1/2018 | Li | |
| 2018/0080446 | A1 | 3/2018 | Choi et al. | |
| 2018/0087509 | A1 | 3/2018 | Johnson et al. | |
| 2018/0223842 | A1 | 8/2018 | Stover et al. | |
| 2018/0223843 | A1 | 8/2018 | Doepker et al. | |
| 2018/0223848 | A1 | 8/2018 | Doepker et al. | |
| 2018/0223849 | A1 | 8/2018 | Doepker et al. | |
| 2018/0224171 | A1 | 8/2018 | Doepker et al. | |
| 2018/0252216 | A1 * | 9/2018 | Lee | F04C 18/0253 |
| 2018/0363654 | A1 | 12/2018 | Doepker et al. | |
| 2019/0162184 | A1 | 5/2019 | Yamashita et al. | |
| 2019/0178247 | A1 | 6/2019 | Yamashita et al. | |
| 2019/0186488 | A1 | 6/2019 | Stover et al. | |
| 2020/0018310 | A1 | 1/2020 | Hirata et al. | |
| 2020/0025199 | A1 | 1/2020 | Wilson et al. | |
| 2020/0232460 | A1 * | 7/2020 | Kitaguchi | F04C 18/023 |

FOREIGN PATENT DOCUMENTS

| | | | |
|---|---|---|---|
| CN | 102480197 | A | 5/2012 |
| CN | 103807166 | A | 5/2014 |
| CN | 104520599 | A | 4/2015 |
| CN | 105612351 | A | 5/2016 |
| CN | 105971880 | A | 9/2016 |
| CN | 208106754 | U | 11/2018 |
| CN | 208106761 | U | 11/2018 |
| CN | 208106763 | U | 11/2018 |
| CN | 208138137 | U | 11/2018 |
| DE | 102018107460 | A1 | 10/2018 |
| EP | 0534891 | A1 | 3/1993 |
| JP | S59110885 | A | 6/1984 |
| JP | S62210279 | A | 9/1987 |
| JP | H02140477 | A | 5/1990 |
| JP | H02207190 | A | 8/1990 |
| JP | H06101659 | A | 4/1994 |
| JP | H06213232 | A | 8/1994 |
| JP | H0712076 | A | 1/1995 |
| JP | H07229481 | A | 8/1995 |
| JP | H07332260 | A | 12/1995 |
| JP | H08121358 | A | 5/1996 |
| JP | H08144972 | A | 6/1996 |
| JP | 2004052657 | A | 2/2004 |
| JP | 2012115084 | A | 6/2012 |
| JP | 2012215092 | A | 11/2012 |
| JP | 2015004296 | A | 1/2015 |
| JP | 2015124653 | A | 7/2015 |
| KR | 910001253 | A | 1/1991 |
| KR | 20110000545 | A | 1/2011 |
| KR | 20120069713 | A | 6/2012 |
| KR | 20150006278 | A | 1/2015 |
| KR | 20160091106 | A | 8/2016 |
| KR | 20180031389 | A | 3/2018 |
| TW | 223674 | B | 5/1994 |
| WO | WO-2018116696 | A1 | 6/2018 |
| WO | WO-2018134739 | A1 | 7/2018 |
| WO | WO-2020050826 | A1 | 3/2020 |

(56) References Cited

OTHER PUBLICATIONS

McMullen, Patrick T. et al., "Combination Radial-Axial Magnetic Bearing." Seventh International Symposium on Magnetic Bearings, Zürich (Aug. 23-25, 2000).
Hinckley, Mark, "New Levels of Performance with Magnetic Bearings." Design World, https://www.designworldonline.com/new-levels-of-performance-with-magnetic-bearings/ (Oct. 8, 2010).
Mahmoudi, A. et al., "Axial-flux permanent-magnet machine modeling, design, simulation and analysis." Scientific Research and Essays, vol. 6, No. 12, pp. 2525-2549 (Jun. 18, 2011).
Faculty of Engineering—Electric Energy Group, "Design of Electric Machines: Axial Flux Machines." Electric Energy Magazine, No. 4, Mondragon Unibertsitatea, pp. 1-21 (Jan.-Jun. 2013).
Frank, Evan et al., "Ring Motors—Design Flexibility for Innovative Configurations." Motion Control and Automation Technology, NASA Tech Briefs, pp. 14-15 (Sep. 2014).
Office Action regarding U.S. Appl. No. 15/205,907, dated May 29, 2018.
International Search Report regarding International Application No. PCT/US2018/017069, dated Jun. 12, 2018.
Written Opinion of the International Searching Authority regarding International Application No. PCT/US2018/017069, dated Jun. 12, 2018.
Search Report regarding European Patent Application No. 18155363.7, dated Jul. 2, 2018.
Search Report regarding European Patent Application No. 18155362.9, dated Jul. 2, 2018.
Office Action regarding U.S. Appl. No. 15/425,374, dated Jul. 27, 2018.
Restriction Requirement regarding U.S. Appl. No. 15/425,428, dated Aug. 8, 2018.
Search Report regarding European Patent Application No. 18155358.7, dated Oct. 11, 2018.
Office Action regarding U.S. Appl. No. 15/425,428, dated Nov. 1, 2018.
Notice of Allowance regarding U.S. Appl. No. 15/425,374, dated Nov. 7, 2018.
Notice of Allowance regarding U.S. Appl. No. 15/425,374, dated Nov. 30, 2018.
Office Action regarding U.S. Appl. No. 16/114,912, dated Dec. 3, 2018.
Restriction Requirement regarding U.S. Appl. No. 15/425,319, dated Jan. 10, 2019.
Notice of Allowance regarding U.S. Appl. No. 15/425,428, dated Feb. 15, 2019.
Office Action regarding Korean Patent Application No. 10-2018-0013623, dated Feb. 18, 2019. Translation provided by KS KORYO International IP Law Firm.
Office Action regarding Chinese Patent Application No. 201810116198.8, dated Feb. 26, 2019. Translation provided by Unitalen Attorneys at Law.
Office Action regarding Korean Patent Application No. 10-2018-0013620, dated Feb. 26, 2019. Translation provided by KS KORYO International IP Law Firm.
Office Action regarding Chinese Patent Application No. 201810119087.2, dated Feb. 27, 2019. Translation provided by Unitalen Attorneys at Law.
Office Action regarding Chinese Patent Application No. 201810118025.X, dated Mar. 4, 2019. Translation provided by Unitalen Attorneys at Law.
Office Action regarding Korean Patent Application No. 10-2018-0013622, dated Mar. 20, 2019. Translation provided by KS KORYO International IP Law Firm.
Office Action regarding Chinese Patent Application No. 201810119178.6, dated Mar. 21, 2019. Translation provided by Unitalen Attorneys at Law.
Office Action regarding Korean Patent Application No. 10-2018-0013621, dated Mar. 25, 2019. Translation provided by KS KORYO International IP Law Firm.
Office Action regarding U.S. Appl. No. 16/114,912, dated Mar. 28, 2019.
Office Action regarding U.S. Appl. No. 15/425,319, dated Apr. 1, 2019.
Office Action regarding Korean Patent Application No. 10-2018-0013620, dated May 28, 2019. Translation provided by KS KORYO International IP Law Firm.
Restriction Requirement regarding U.S. Appl. No. 15/425,266, dated May 28, 2019.
Notice of Allowance regarding U.S. Appl. No. 16/114,912, dated Jun. 10, 2019.
Office Action regarding Korean Patent Application No. 10-2018-0013622, dated Jun. 26, 2019. Translation provided by Ks Koryo International IP Law Firm.
Office Action regarding U.S. Appl. No. 16/284,653, dated Jul. 29, 2019.
Notice of Allowance regarding U.S. Appl. No. 15/425,319, dated Aug. 7, 2019.
Office Action regarding U.S. Appl. No. 15/205,907, dated Aug. 9, 2019.
Office Action regarding Chinese Patent Application No. 201810116198.8, dated Aug. 26, 2019. Translation provided by Unitalen Attorneys at Law.
Office Action regarding Chinese Patent Application No. 201810118025.X, dated Aug. 28, 2019. Translation provided by Unitalen Attorneys at Law.
Office Action regarding Indian Patent Application No. 201824003471, dated Sep. 11, 2019.
Office Action regarding Mexican Patent Application No. MX/a/2017/008998, dated Oct. 1, 2019. Translation provided by Panamericana de Patentes y Marcas, S.C.
Office Action regarding U.S. Appl. No. 15/425,266, dated Oct. 8, 2019.
Office Action regarding Chinese Patent Application No. 201810119178.6, dated Oct. 18, 2019. Translation provided by Unitalen Attorneys at Law.
Office Action regarding Chinese Patent Application No. 201810118025.X, dated Feb. 25, 2020. Translation provided by Unitalen Attorneys at Law.
Notice of Allowance regarding U.S. Appl. No. 16/284,653, dated Mar. 12, 2020.
Office Action regarding U.S. Appl. No. 15/425,266, dated Apr. 3, 2020.
Office Action regarding U.S. Appl. No. 15/877,870, dated Apr. 13, 2020.
Office Action regarding Chinese Patent Application No. 201880016172.4, dated Jul. 1, 2020. Translation provided by Unitalen Attorneys at Law.
Office Action regarding Chinese Patent Application No. 201710551365.7, dated Jul. 3, 2020. Summary translation provided by Zhongzi Law Office.
Office Action regarding U.S. Appl. No. 15/425,266, dated Jul. 6, 2020.
Hasegawa, Hiroshi et al., "Dynamic Analysis of a Co-Rotating Scroll Compressor." International Compressor Engineering Conference, Paper 1313, pp. 643-648 (1998).
Office Action regarding European Patent Application No. 18155358.7, dated Oct. 6, 2020.
Ex Parte Quayle Action regarding U.S. Appl. No. 15/877,870, dated Oct. 19, 2020.
Office Action regarding U.S. Appl. No. 15/425,266, dated Aug. 28, 2020.
Office Action regarding European Patent Application No. 18155363.7, dated Oct. 7, 2020.
Office Action regarding European Patent Application No. 18155362.9, dated Oct. 2, 2020.
Office Action regarding Korean Patent Application No. 10-2019-7023591, dated Oct. 19, 2020. Translation provided by Y.S. Chang & Associates.
Notice of Allowance regarding U.S. Appl. No. 15/877,870, dated Jan. 28, 2021.
Office Action regarding U.S. Appl. No. 15/425,266, dated Feb. 10, 2021.

(56) References Cited

OTHER PUBLICATIONS

Office Action regarding Chinese Patent Application No. 201880016172.4, dated Feb. 26, 2021. Translation provided by Unitalen Attorneys at Law.
International Search Report regarding International Application No. PCT/US2020/060527, dated Mar. 5, 2021.
Written Opinion of the International Searching Authority regarding International Application No. PCT/US2020/060527, dated Mar. 5, 2021.
Notice of Allowance regarding U.S. Appl. No. 15/425,266 dated May 19, 2021.
Supplemental Notice of Allowability regarding U.S. Appl. No. 15/425,266 dated May 27, 2021.
Search Report regarding European Patent Application No. 21186670.2, dated Oct. 26, 2021.
CA Non-Final Office Action regarding U.S. Appl. No. 17/097,478 dated Nov. 1, 2021.
English language translation equivalent for WO-2018116696-A1 is provided in the form of U.S. Pat. No. 11,041,494.
English language translation equivalent for TW-223674-B is provided in the form of EP-0534891-A1.
English language translation equivalent for JP-S62210279-A is provided in the form of U.S. Pat. No. 4,846,639-A.
U.S. Appl. No. 17/519,721, filed Nov. 5, 2021, Kirill M. Ignatiev.
U.S. Appl. No. 17/519,953, filed Nov. 5, 2021, Kirill M. Ignatiev.
Notice of Allowance regarding U.S. Appl. No. 17/097,478 dated Feb. 16, 2022.
Non-Final Office Action regarding U.S. Appl. No. 17/519,953 dated Jul. 20, 2022.
Non-Final Office Action regarding U.S. Appl. No. 17/519,721 dated Aug. 2, 2022.

* cited by examiner

CO-ROTATING SCROLL COMPRESSOR HAVING FIRST AND SECOND OLDHAM COUPLINGS

FIELD

The present disclosure relates to a co-rotating scroll compressor with Oldham couplings.

BACKGROUND

This section provides background information related to the present disclosure and is not necessarily prior art.

A climate-control system (e.g., a heat-pump system, an air-conditioning system, a refrigeration system, etc.) may include a fluid circuit having an outdoor heat exchanger, an indoor heat exchanger, an expansion device disposed between the indoor and outdoor heat exchangers, and a compressor circulating a working fluid between the indoor and outdoor heat exchangers. Efficient and reliable operation of the compressor is desirable to ensure that the climate-control system in which the compressor is installed is capable of effectively and efficiently providing a cooling and/or heating effect on demand.

SUMMARY

This section provides a general summary of the disclosure and is not a comprehensive disclosure of its full scope or all of its features.

The present disclosure provides a compressor that may include a shell assembly, a first scroll member, a second scroll member, a driveshaft, a first bearing, a second bearing, a first Oldham coupling, and a second Oldham coupling. The first scroll member is disposed within the shell assembly. The second scroll member is disposed within the shell assembly and cooperates with the first scroll member to define compression pockets therebetween. The driveshaft may be coupled to the first scroll member and configured to rotate the first scroll member relative to the shell assembly. The first bearing may define a first rotational axis about which the driveshaft and the first scroll member rotate. The second bearing is spaced apart from the first bearing and may support the second scroll member for rotation about a second rotational axis that is offset from the first rotational axis. The first Oldham coupling may include a first body and a plurality of first keys extending from the first body. The first keys may slidably engage first slots formed in the second scroll member. The second Oldham coupling is separate and distinct from the first Oldham coupling. The second Oldham coupling may include a second body and a plurality of second keys extending from the second body. The second keys may slidably engage second slots formed in a surface that rotates about the first rotational axis.

In some configurations of the compressor of the above paragraph, during operation of the compressor, rotation of a center of gravity of the first Oldham coupling is out of phase with rotation of a center of gravity of the second Oldham coupling.

In some configurations of the compressor of either of the above paragraphs, the centers of gravity of the first and second Oldham couplings rotate at a rotational speed that is greater than a rotational speed of the first and second scroll members.

In some configurations of the compressor of any of the above paragraphs, the surface in which the second slots are formed is an axially facing surface of a bearing support member. The bearing support member may be rotationally fixed relative to the first scroll member.

In some configurations of the compressor of any of the above paragraphs, the first and second bodies of the first and second Oldham couplings are annular bodies that extend around a hub of the second scroll member. The hub may extend from a first side of an end plate of the second scroll member. A spiral wrap extends from a second side of the end plate.

In some configurations of the compressor of any of the above paragraphs, the first keys of the first Oldham coupling extend from the first body in first and second opposite directions. The second keys of the second Oldham coupling may extend from the second body in first and second opposite directions.

In some configurations of the compressor of any of the above paragraphs, the first keys are disposed 180 degrees apart from each other, and the second keys are disposed 180 degrees apart from each other.

In some configurations of the compressor of any of the above paragraphs, the first Oldham coupling includes third keys extending from the first body, and the second Oldham coupling includes fourth keys extending from the second body.

In some configurations of the compressor of any of the above paragraphs, the first keys of the first Oldham coupling extend from the first body in a first direction. The third keys of the first Oldham coupling extend from the first body in a second direction that is opposite the first direction. The second keys of the second Oldham coupling extend from the second body in the second direction. The fourth keys of the second Oldham coupling extend from the second body in the first direction.

In some configurations of the compressor of any of the above paragraphs, the first keys are disposed 180 degrees apart from each other, the second keys are disposed 180 degrees apart from each other, the third keys are disposed 180 degrees apart from each other, and the fourth keys are disposed 180 degrees apart from each other.

In another form, the present disclosure provides a compressor that may include a shell assembly, a first bearing support member, a first scroll member, a second scroll member, a first Oldham coupling, and a second Oldham coupling. The first bearing support member may be fixed relative to the shell assembly and may include a first cylindrical surface and a second cylindrical surface that is eccentric relative to the first cylindrical surface. The first scroll member may be rotatable relative to the first bearing support member about a first rotational axis defined by the first cylindrical surface. The second scroll member may cooperate with the first scroll member to define compression pockets therebetween. The second scroll member may be rotatable relative to the first bearing support member about a second rotational axis defined by the second cylindrical surface. The first Oldham coupling may include a first body and a plurality of first keys extending from the first body. The first keys may slidably engage first slots formed in the second scroll member. The second Oldham coupling is separate and distinct from the first Oldham coupling. The second Oldham coupling may include a second body and a plurality of second keys extending from the second body. The second keys may slidably engage second slots formed in a surface that rotates about the first rotational axis.

In some configurations of the compressor of the above paragraph, during operation of the compressor, rotation of a center of gravity of the first Oldham coupling is out of phase with rotation of a center of gravity of the second Oldham coupling.

In some configurations of the compressor of either of the above paragraphs, the centers of gravity of the first and second Oldham couplings rotate at a rotational speed that is greater (for example, two times greater) than a rotational speed of the first and second scroll members.

In some configurations of the compressor of any of the above paragraphs, the surface in which the second slots are formed is an axially facing surface of a second bearing support member. The second bearing support member may be rotationally fixed relative to the first scroll member. The compressor may include a first bearing and a second bearing. The first bearing may be attached to the second bearing support member and the first cylindrical surface of the first bearing support member. The second bearing may surround the second cylindrical surface of the first bearing support member and may be disposed within a cavity of the second bearing support member. A bushing may be disposed between the second bearing and the second cylindrical surface of the first bearing support member. This bushing may provide radial compliance for the scroll members.

In some configurations of the compressor of any of the above paragraphs, the first and second bodies of the first and second Oldham couplings are annular bodies that extend around a hub of the second scroll member. The hub may extend from a first side of an end plate of the second scroll member. A spiral wrap extends from a second side of the end plate.

In some configurations of the compressor of any of the above paragraphs, the first keys of the first Oldham coupling extend from the first body in first and second opposite directions, and the second keys of the second Oldham coupling extend from the second body in first and second opposite directions.

In some configurations of the compressor of any of the above paragraphs, the first keys are disposed 180 degrees apart from each other, and the second keys are disposed 180 degrees apart from each other.

In some configurations of the compressor of any of the above paragraphs, the first Oldham coupling includes third keys extending from the first body, and the second Oldham coupling includes fourth keys extending from the second body.

In some configurations of the compressor of any of the above paragraphs, the first keys of the first Oldham coupling extend from the first body in a first direction, the third keys of the first Oldham coupling extend from the first body in a second direction that is opposite the first direction, the second keys of the second Oldham coupling extend from the second body in the second direction, and the fourth keys of the second Oldham coupling extend from the second body in the first direction.

In some configurations of the compressor of any of the above paragraphs, the first keys are disposed 180 degrees apart from each other, the second keys are disposed 180 degrees apart from each other, the third keys are disposed 180 degrees apart from each other, and the fourth keys are disposed 180 degrees apart from each other.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
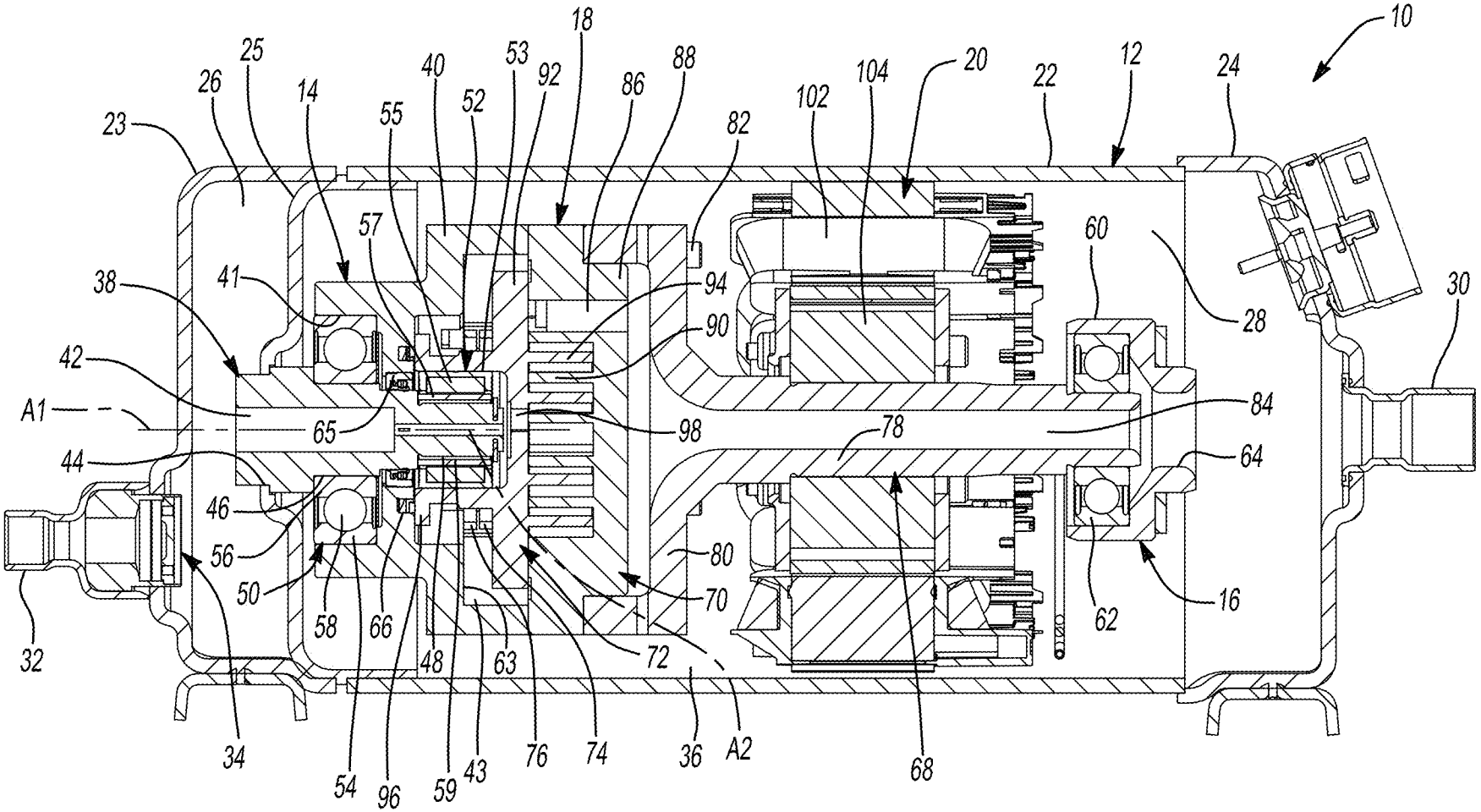
FIG. 1 is a cross-sectional view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-14, a compressor 10 is provided that may include a shell assembly 12, a first bearing housing 14, a second bearing housing 16, a compression mechanism 18, and a motor assembly 20. The shell assembly 12 may include a shell body 22, a first end cap 23, a second end cap 24, and partition (or muffler plate) 25. The shell body 22 may be generally cylindrical. The first and second end caps 23, 24 may be fixedly attached to opposing axial ends of the shell body 22. The partition 25 may be fixedly attached to the shell body 22 and/or the first end cap 23 and may extend transversely across the shell body 22.

The partition 25 and the first end cap 23 may cooperate to define a discharge chamber 26 that receives compressed working fluid from the compression mechanism 18. The partition 25, the shell body 22, and the second end cap 24 may cooperate to define a suction chamber 28. The first and second bearing housings 14, 16, the compression mechanism 18, and the motor assembly 20 may be disposed within the suction chamber 28. The suction chamber 28 may receive suction-pressure working fluid from a suction inlet fitting 30 attached to the second end cap 24 or shell body 22. That is, suction-pressure working fluid (i.e., low-pressure working fluid) may enter the suction chamber 28 through the suction inlet fitting 30 and may be drawn into the compression mechanism 18 for compression therein. The compression mechanism 18 discharges compressed working fluid (i.e., discharge-pressure working fluid at a higher pressure than suction pressure) into the discharge chamber 26. Working fluid in the discharge chamber 26 may be discharged from the compressor 10 through a discharge outlet fitting 32 attached to the first end cap 23. In some configurations, a discharge valve 34 may be disposed within the discharge outlet fitting 32. The discharge valve 34 may be a check valve that allows fluid to exit the discharge chamber 26 through the discharge outlet fitting 32 and prevents fluid from entering the discharge chamber 26 through the discharge outlet fitting 32.

The compressor 10 shown in the figures is a low-side compressor (i.e., the motor assembly 20 and at least a majority of the compression mechanism 18 are disposed in the suction chamber 28). It will be appreciated, however, that the principles of the present disclosure are applicable to high-side compressors (i.e., compressors having the compression mechanism 18 disposed in the discharge chamber).

The first bearing housing 14 may include a first bearing support member 38 and a second bearing support member 40. The first bearing support member 38 may be a generally cylindrical shaft or body having a discharge passage 42 extending axially therethrough. The first bearing support member 38 may be fixed relative to the shell assembly 12. For example, the first bearing support member 38 may be fixedly attached to the partition 25 and may extend through an opening 44 in the partition 25. In other configurations, the first bearing support member 38 could be integrally formed with the partition 25 or the first bearing support member 38 could be attached to or integrally formed with the first end cap 23. The discharge passage 42 is in fluid communication with the discharge chamber 26 and the compression mechanism 18 such that compressed working fluid discharged from the compression mechanism 18 flows through the discharge passage 42 into the discharge chamber 26.

The first bearing support member 38 includes a first cylindrical surface 46 and a second cylindrical surface 48. The first cylindrical surface 46 may support a first bearing 50 and may define a first rotational axis A1. The second cylindrical surface 48 is eccentric relative to the first cylindrical surface 46 and partially defines a second rotational axis A2 that is parallel to and laterally offset from (i.e., non-collinear with) the first rotational axis A1. The second cylindrical surface 48 supports a second bearing 52.

The first bearing 50 may be rolling element bearing that may include an outer ring 54, an inner ring 56, and a plurality of rolling elements (e.g., spheres or cylinders) 58 disposed between the outer and inner rings 54, 56. The inner ring 56 of the first bearing 50 may be fixedly attached to the first cylindrical surface 46 of the first bearing support member 38. The outer ring 54 of the first bearing 50 may be attached to the second bearing support member 40.

The second bearing 52 may include an outer ring 53 and rolling elements 55. The rolling elements 55 may be arranged around a bushing 57. The outer ring 53 surrounds the rolling elements 55 and the bushing 57. The bushing 57 surrounds the second cylindrical surface 48 of the first bearing support member 38. A gap 59 may be disposed radially between the second cylindrical surface 48 and the bushing 57. The outer ring 53 of the second bearing 52 may be attached to the compression mechanism 18 (as will be described in more detail below). The bushing 57, radial gap 59, and the second cylindrical surface 48 define the second rotational axis A2. The bushing 57 allows for radial compliance of scroll members 70, 72.

Figure 3:
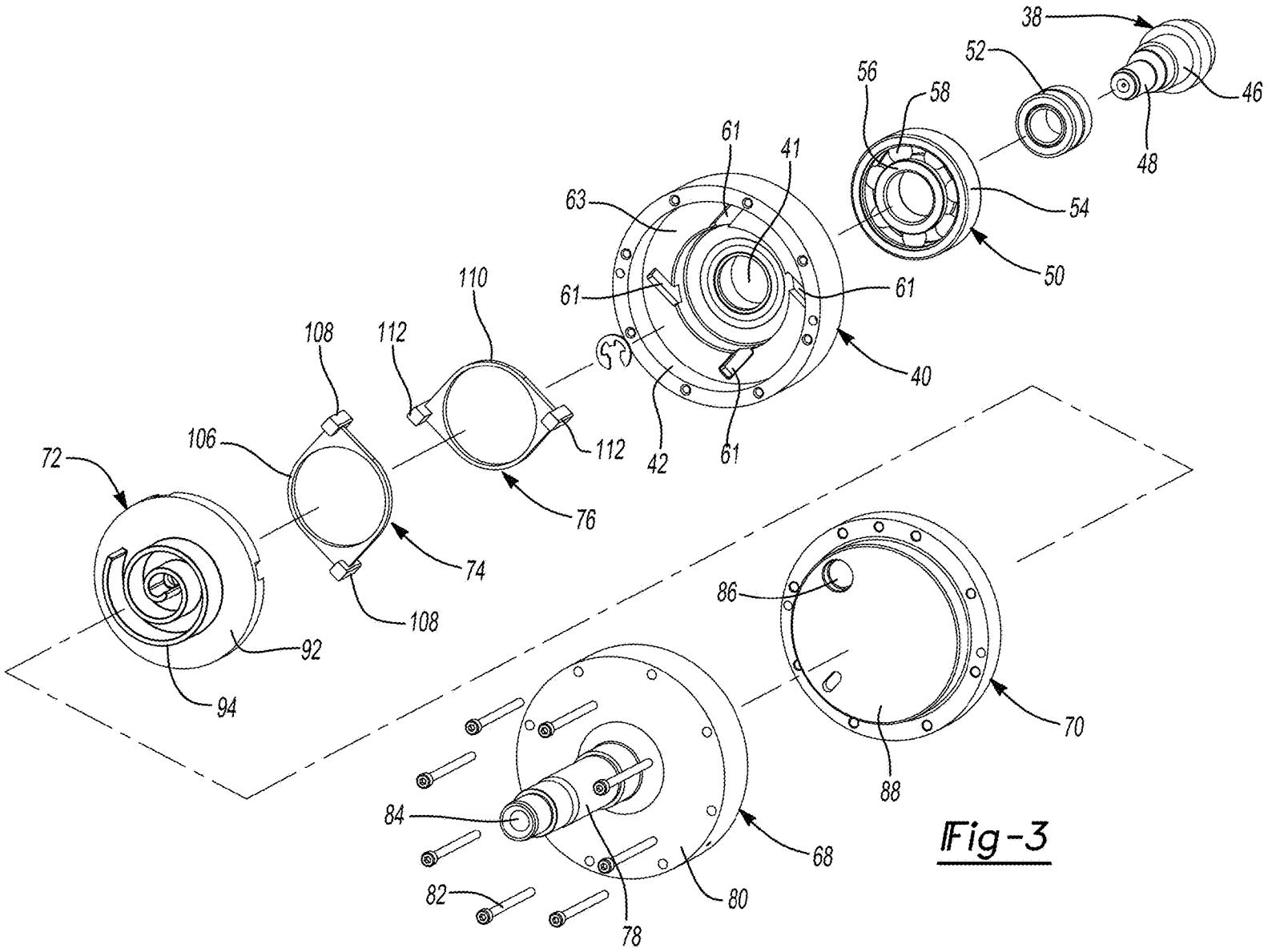
FIG. 3 is another exploded perspective view of a bearing housing and compression mechanism.
Figure 4:
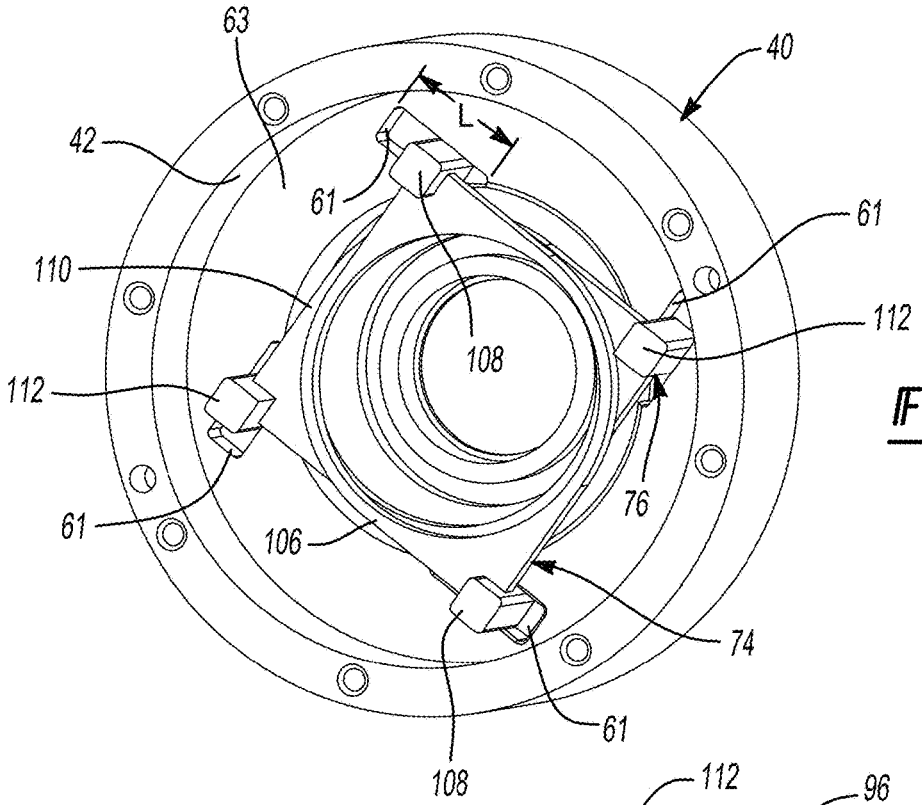
FIG. 4 is a perspective view of a bearing support member and Oldham couplings of the compressor.

The second bearing support member 40 may be an annular member having a first cavity 41 and a second cavity 43. The first cavity 41 may receive the first bearing 50. The second cavity 43 may receive a portion of the compression mechanism 18. The second bearing support member 40 may include a plurality of slots 61 (FIGS. 3 and 4). For example, the slots 61 may be formed in an axially facing surface 63 (i.e., a surface that faces a direction parallel to the direction in which axes A1, A2 extend) of the second bearing support member 40. An annular seal 65 may be disposed within the second bearing support member 40 (e.g., axially between the first and second cavities 41, 43). The seal 65 may sealingly engage the second bearing support member 40 and the first bearing support member 38. Another annular seal 66 sealingly engages the second bearing support member 40 and a second scroll member 72. The seals 65, 66 prevent compressed working fluid (i.e., working fluid discharged from the compression mechanism 18) from flowing into the suction chamber 28.

The second bearing housing 16 may include an annular central hub 60 and a plurality of arms (not shown) that extend radially outward from the hub 60 and fixedly engage the shell assembly 12 (e.g., the shell body 22). The hub 60 receives a third bearing 62. The hub 60 may also include a central aperture 64.

The compression mechanism 18 may include a driveshaft 68, a first scroll member 70, the second scroll member 72, a first Oldham coupling (or Oldham ring) 74, and a second Oldham coupling (or Oldham ring) 76. The first and second scroll members 70, 72 cooperate to define fluid pockets (i.e., compression pockets) therebetween. The compression mechanism 18 is a co-rotating scroll compression mechanism in which the first scroll member 70 is a driven scroll member and the second scroll member 72 is an idler scroll member.

The driveshaft 68 may include a shaft portion 78 and a flange portion 80. The shaft portion 78 is rotatably supported by the third bearing 62 and extends through the motor assembly 20. The flange portion 80 extends radially outward from an axial end of the shaft portion 78. Fasteners 82 may extend through apertures in the flange portion 80, the first scroll member 70, and the second bearing support member 40 to rotationally fix the first scroll member 70 and the second bearing support member relative to the driveshaft 68 (i.e., so that the first scroll member 70 and second bearing support member 40 rotate with the driveshaft 68 about the first rotational axis A1). The driveshaft 68 may include one or more apertures 84 through which suction-pressure working fluid in the suction chamber 28 can flow into a suction inlet opening 86 in the first scroll member 70.

The first scroll member 70 may include a first end plate 88 and a first spiral wrap 90 extending from the first end plate 88. The suction inlet opening 86 may be disposed in the first end plate 88. The second scroll member 72 may include a second end plate 92, a second spiral wrap 94 extending from one side of the second end plate 92, and a hub 96 extending from the opposite side of the second end plate 92. The second end plate 92 may include a discharge passage 98 that is in fluid communication with the discharge passage 42 in the first bearing support member 38.

Figure 2:
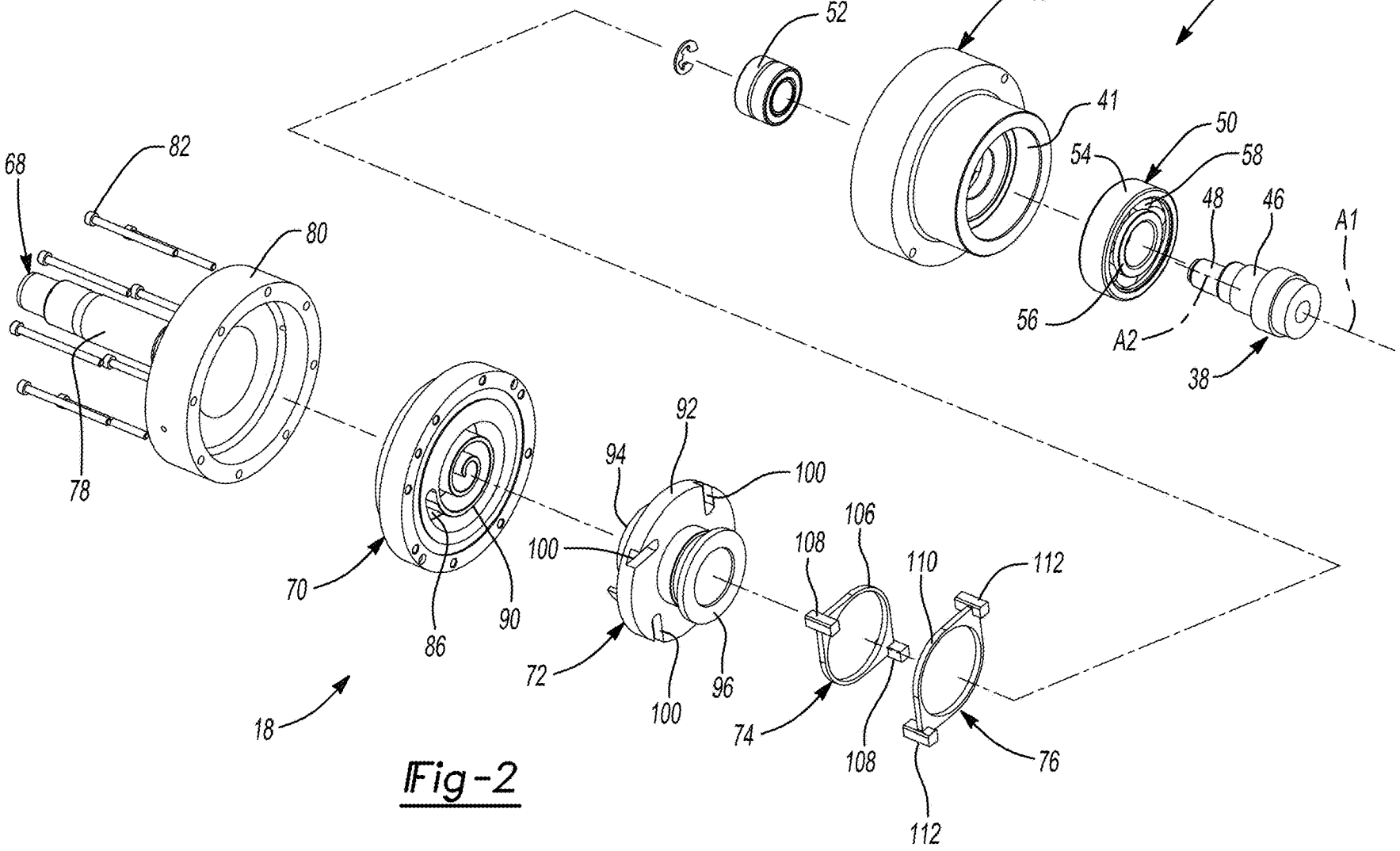
FIG. 2 is an exploded perspective view of a bearing housing and compression mechanism of the compressor of FIG. 1.
Figure 5:
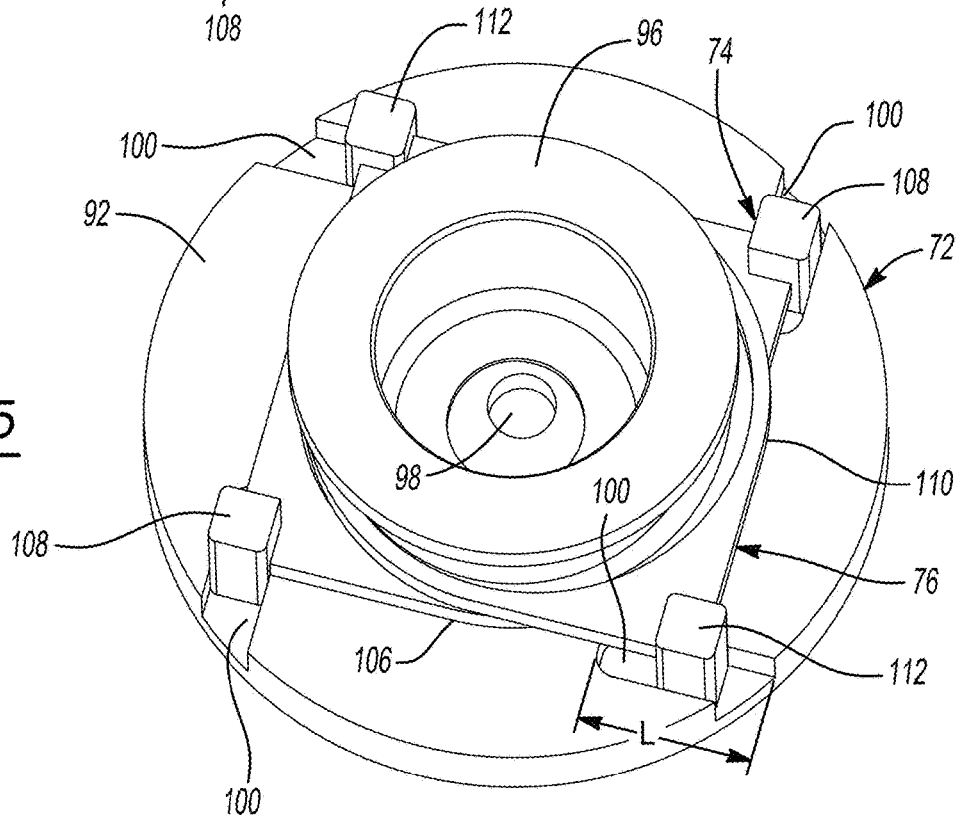
FIG. 5 is a perspective view of a scroll member and the Oldham couplings.

The second scroll member 72 may be disposed within the second cavity 43 of the second bearing support member 40. The eccentric second cylindrical surface 48 of the first bearing support member 38 may be received within the hub 96 of the second scroll member 72. The hub 96 of the second scroll member 72 may be rotatably supported by the second bearing 52, the bushing 57, and the eccentric second cylindrical surface 48 of the first bearing support member 38. In this manner, the second scroll member 72 is rotatable about the second rotational axis A2. As shown in FIGS. 2 and 5, the second end plate 92 of the second scroll member 72 includes a plurality of slots 100.

As will be described in more detail below, the Oldham couplings 74, 76 may be keyed to the second bearing support member 40 and the second scroll member 72. The Oldham couplings 74, 76 transmit rotational energy of the driveshaft 68, first scroll member 70 and second bearing support member 40 to the second scroll member 72 such that rotation of the driveshaft 68, first scroll member 70 and second bearing support member 40 about the first rotational axis A1 causes corresponding rotation of the second scroll member 72 about the second rotational axis A2. The first and second spiral wraps 90, 94 are intermeshed with each other and cooperate to form a plurality of fluid pockets (i.e., compression pockets) therebetween. Rotation of the first scroll member 70 about the first rotational axis A1 and rotation of the second scroll member 72 about the second rotational axis A2 causes the fluid pockets to decrease in size as they move from a radially outer position to a radially inner position, thereby compressing the working fluid therein from the suction pressure to the discharge pressure.

The motor assembly 20 may be disposed within the suction chamber 28 and may include a motor stator 102 and a rotor 104. The motor stator 102 may be attached to the shell body 22 (e.g., via press fit, staking, and/or welding). The rotor 104 may be attached to the shaft portion 78 of the driveshaft 68 (e.g., via press fit, staking, and/or welding). The driveshaft 68 may be driven by the rotor 104 for rotation relative to the shell assembly 12 about the first rotational axis A1. The motor assembly 20 could be a fixed-speed motor, a multi-speed motor or a variable-speed motor.

As shown in FIGS. 2-5, the first Oldham coupling 74 may include an annular body 106 and a pair of keys 108. The keys 108 may be rectangular protrusions (i.e., rectangular prisms). The keys 108 may be disposed approximately 180 degrees apart from each other. The keys 108 extend axially from both opposing sides of the annular body 106. In other words, the body 106 is attached to the keys 108 at a location between opposing ends of the keys 108.

The second Oldham coupling 76 may include an annular body 110 and a pair of keys 112. The keys 112 may be rectangular protrusions (i.e., rectangular prisms). The keys 112 may be disposed approximately 180 degrees apart from each other. The keys 112 extend axially from both opposing sides of the annular body 110. In other words, the body 110 is attached to the keys 112 at a location between opposing ends of the keys 112. The Oldham couplings 74, 76 may be similar or identical to each other. The Oldham couplings 74, 76 are separate and distinct from each other and are movable relative to each other during operation of the compressor 10.

The keys 108, 112 of the Oldham couplings 74, 76 are slidably received in respective slots 61, 100 of the second bearing support member 40 and second scroll member 72. The slots 61 in the second bearing support member 40 are arranged in a circular pattern centered on the first rotational axis A1. Each slot 61 is disposed approximately 90 degrees apart from angularly adjacent slots 61. Each slot 61 is oriented such that its length L (i.e., the dimension along which keys 108, 112 are slidable) is: (a) perpendicular to the lengths L of the angularly adjacent slots 61 (i.e., each slot 61 is perpendicular to the slots 61 that are 90 degrees apart from each other) and (b) parallel to but not aligned with the angular opposite slot 61 (i.e., the slots 61 that are 180 degrees apart from each other are parallel to each other and are not aligned with each other). Longitudinal axes that extend along the lengths L of the slots 61 do not intersect the center of the rotational axes A1, A2.

Similarly, the slots 100 of the second scroll member 72 are also arranged in a circular pattern centered on the first rotational axis A1. Each slot 100 is disposed approximately 90 degrees apart from angularly adjacent slots 100. Each slot 100 is oriented such that its length L (i.e., the dimension along which keys 108, 112 are slidable) is: (a) perpendicular to the lengths L of the angularly adjacent slots 100 (i.e., each slot 100 is perpendicular to the slots 100 that are 90 degrees apart from each other) and (b) parallel to but not aligned with the angular opposite slot 100 (i.e., the slots 100 that are 180 degrees apart from each other are parallel to each other and are not aligned with each other). Longitudinal axes that extend along the lengths L of the slots 100 do not intersect the center of the rotational axes A1, A2.

The Oldham couplings 74, 76 are disposed within the second cavity 43 of the second bearing support member 40 and are disposed between the axially facing surface 63 of the second bearing support member 40 and the end plate 92 of the second scroll member 72. The annular bodies 106, 110 of the Oldham couplings 74, 76 are disposed around the hub 96 of the second scroll member 72 (i.e., the hub 96 extends through the annular bodies 106, 110 of the Oldham couplings 74, 76).

Figure 6:
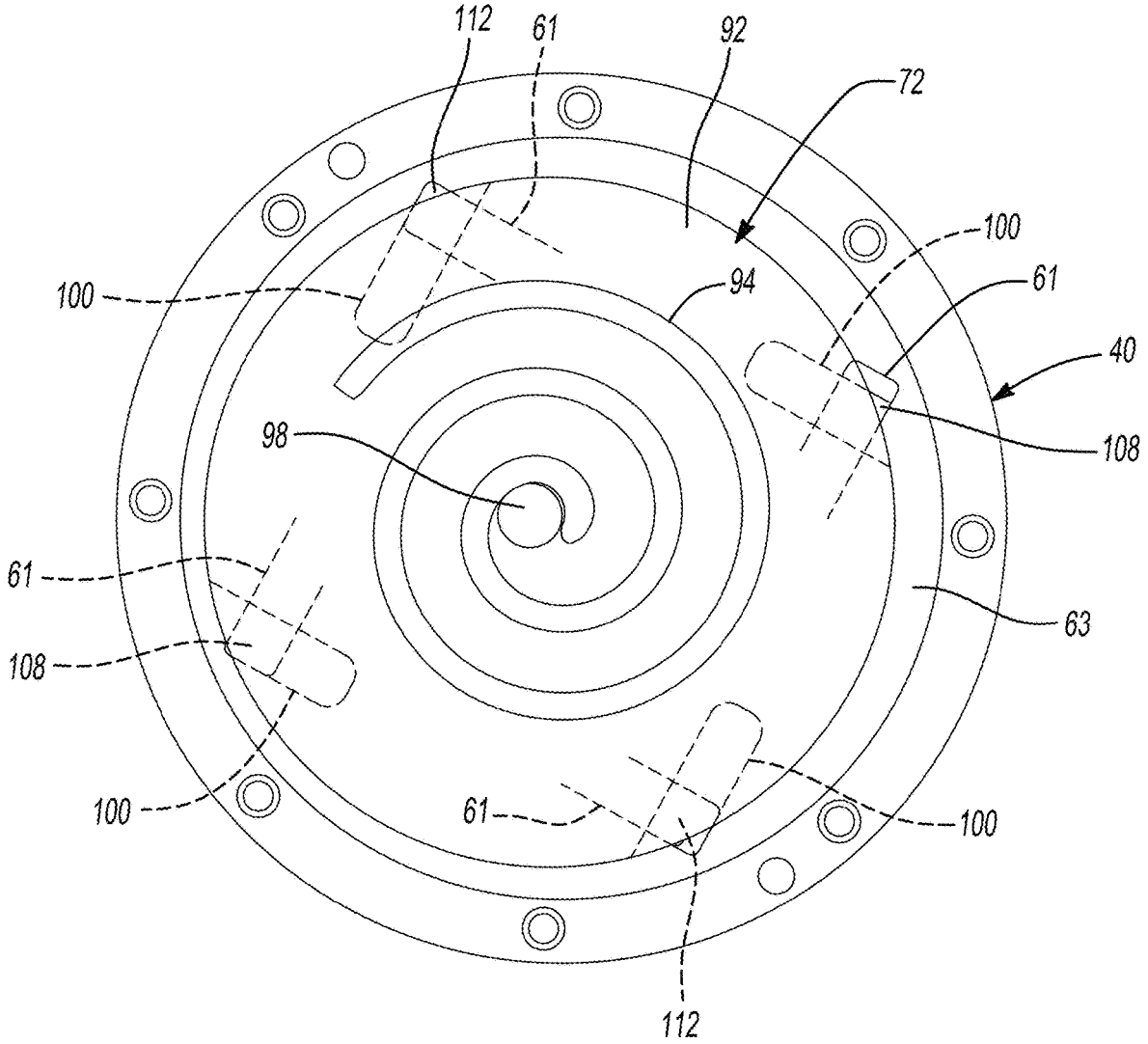
FIG. 6 is a plan view of the bearing support member and scroll member.
Figure 7:
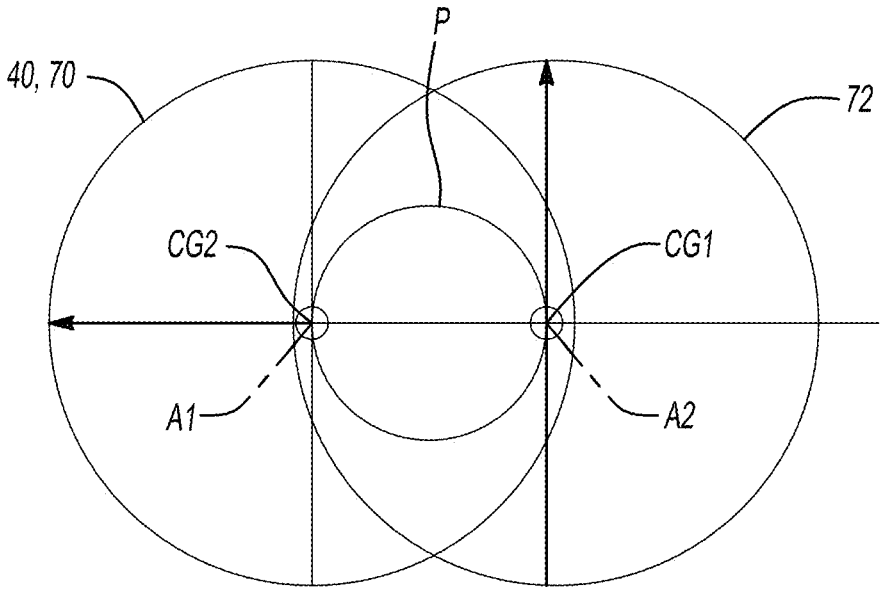
FIG. 7 is a schematic representation of scroll members at a first rotational position.
Figure 8:
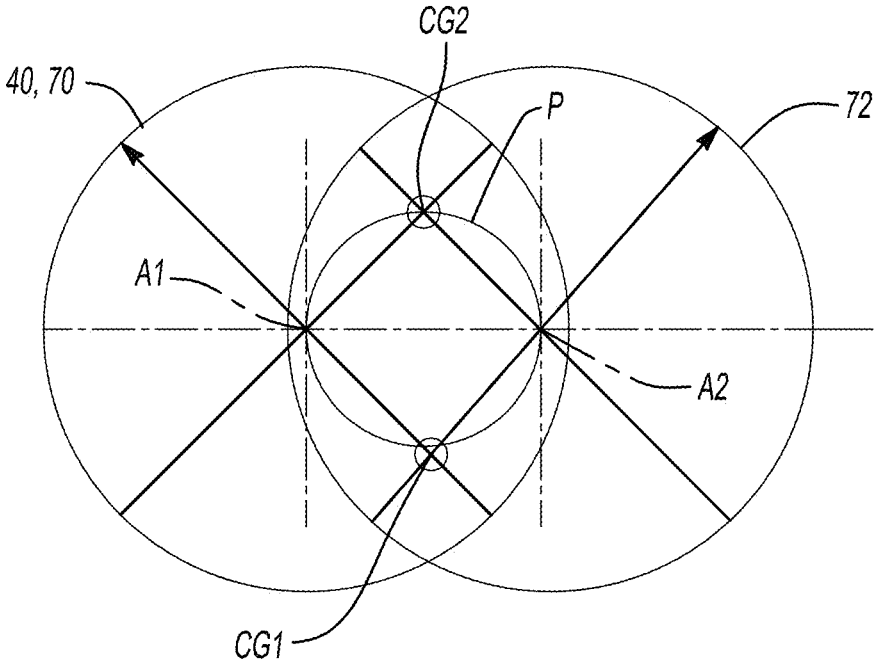
FIG. 8 is a schematic representation of the scroll members at a second rotational position.
Figure 9:
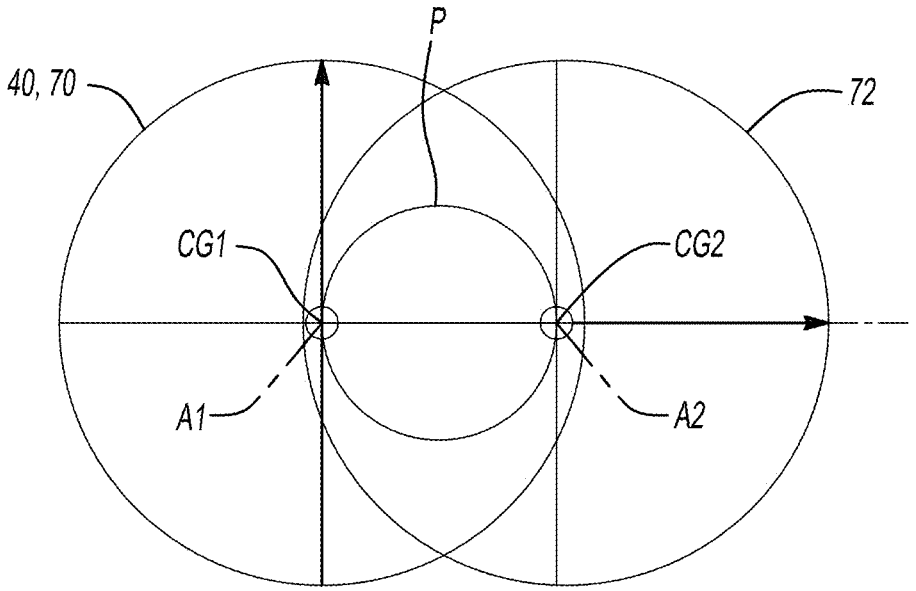
FIG. 9 is a schematic representation of scroll members at a third rotational position.
Figure 10:
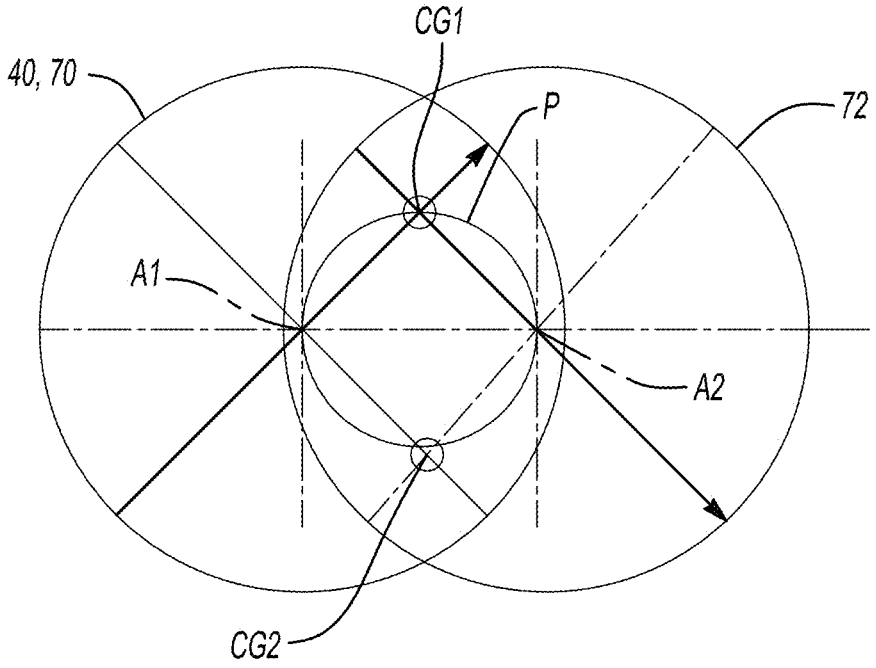
FIG. 10 is a schematic representation of scroll members at a fourth rotational position.
Figure 11:
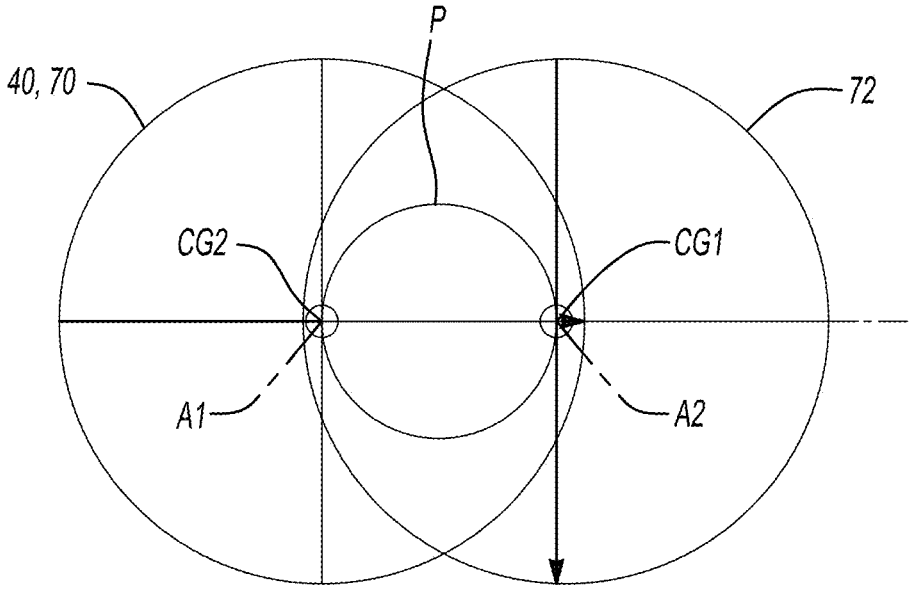
FIG. 11 is a schematic representation of scroll members at a fifth rotational position.
Figure 12:
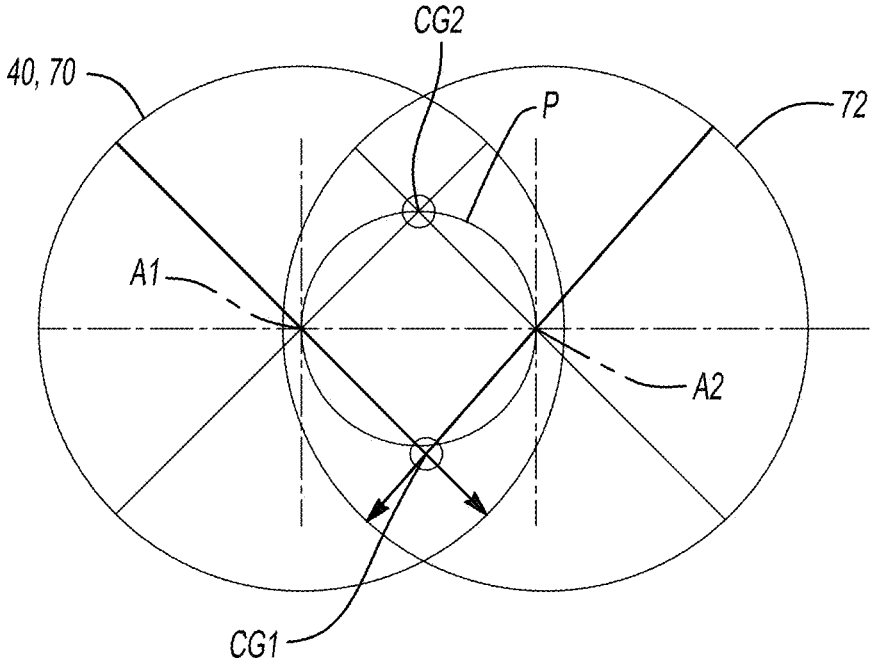
FIG. 12 is a schematic representation of scroll members at a sixth rotational position.
Figure 13:
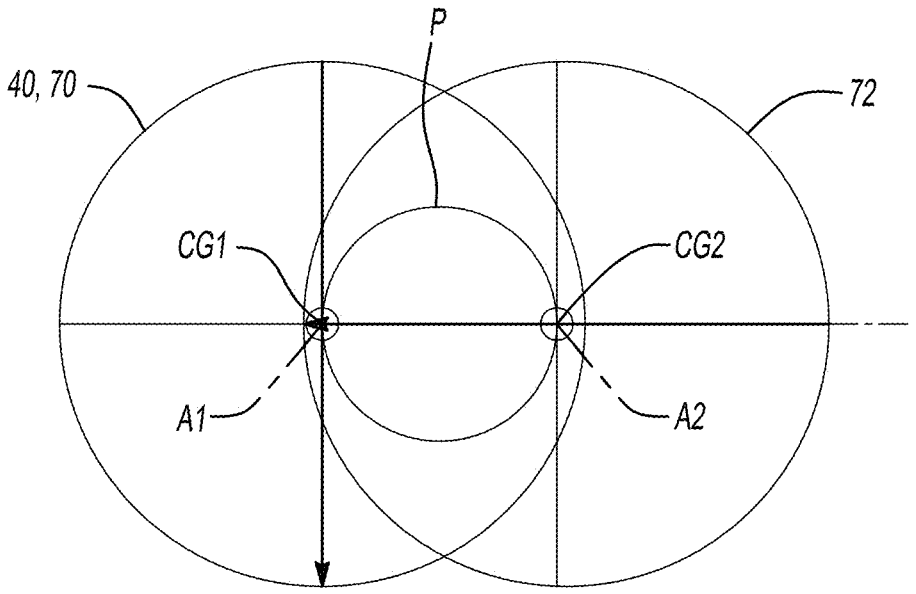
FIG. 13 is a schematic representation of scroll members at a seventh rotational position.
Figure 14:
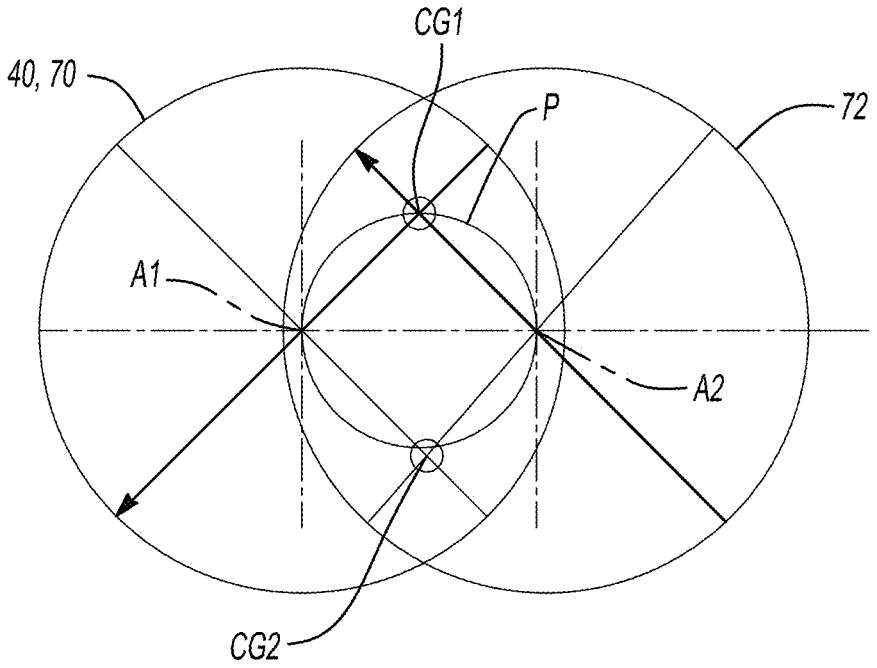
FIG. 14 is a schematic representation of scroll members at an eighth rotational position.
Figure 15:
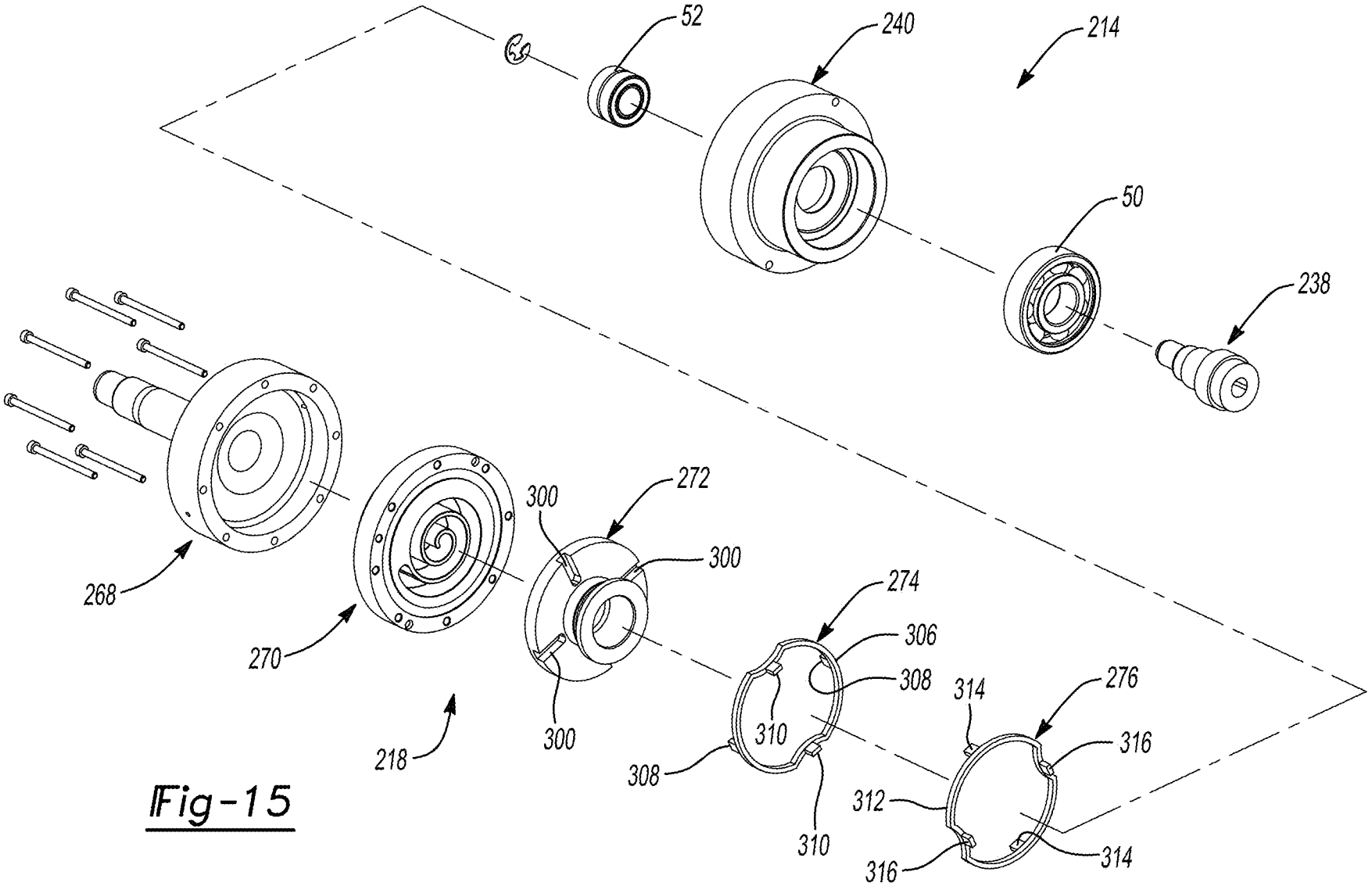
FIG. 15 is an exploded perspective view of an alternative bearing housing and an alternative compression mechanism according to the principles of the present disclosure.
Figure 16:
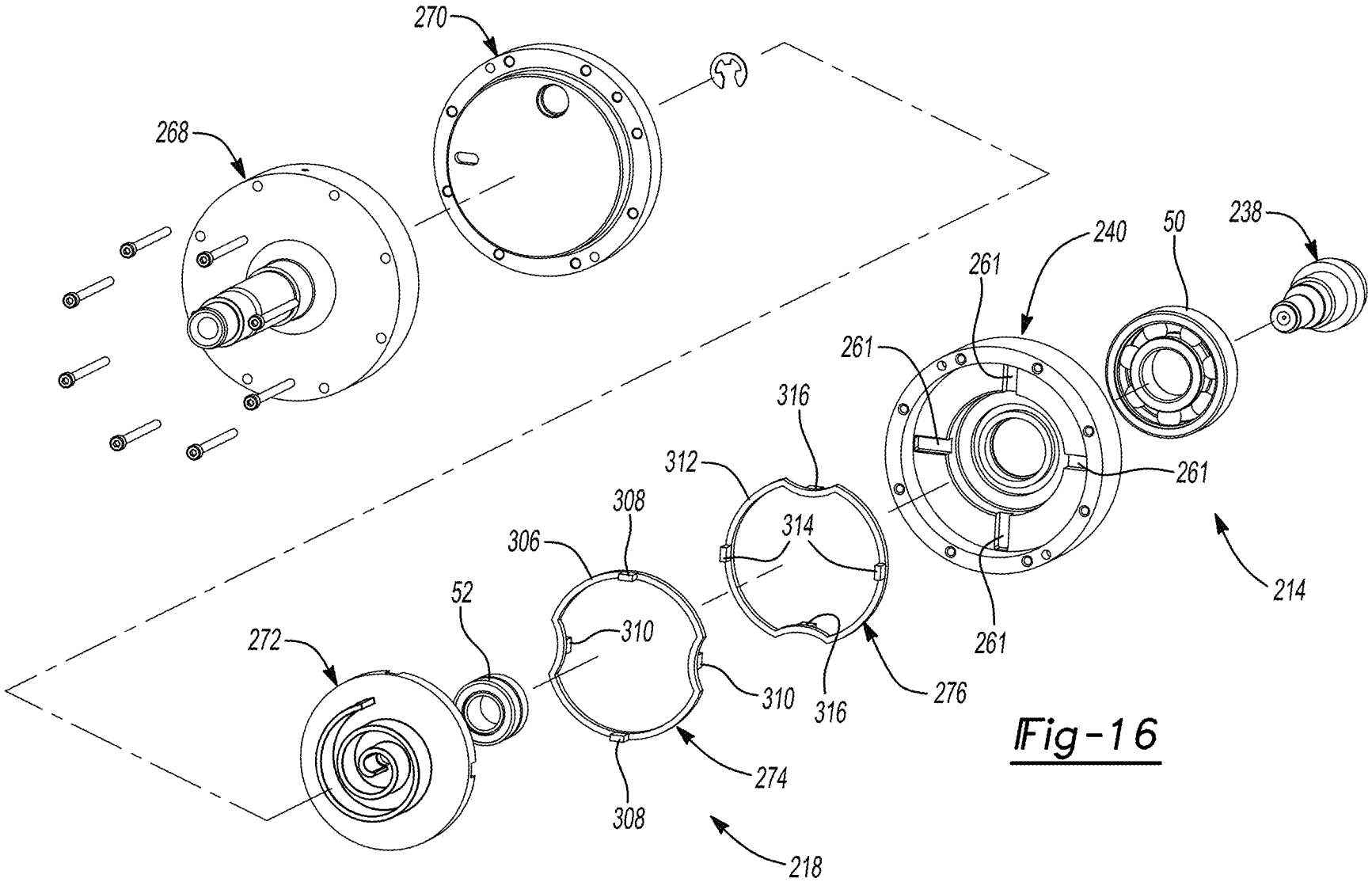
FIG. 16 is another exploded perspective view of the bearing housing and compression mechanism of FIG. 15.
Figure 17:
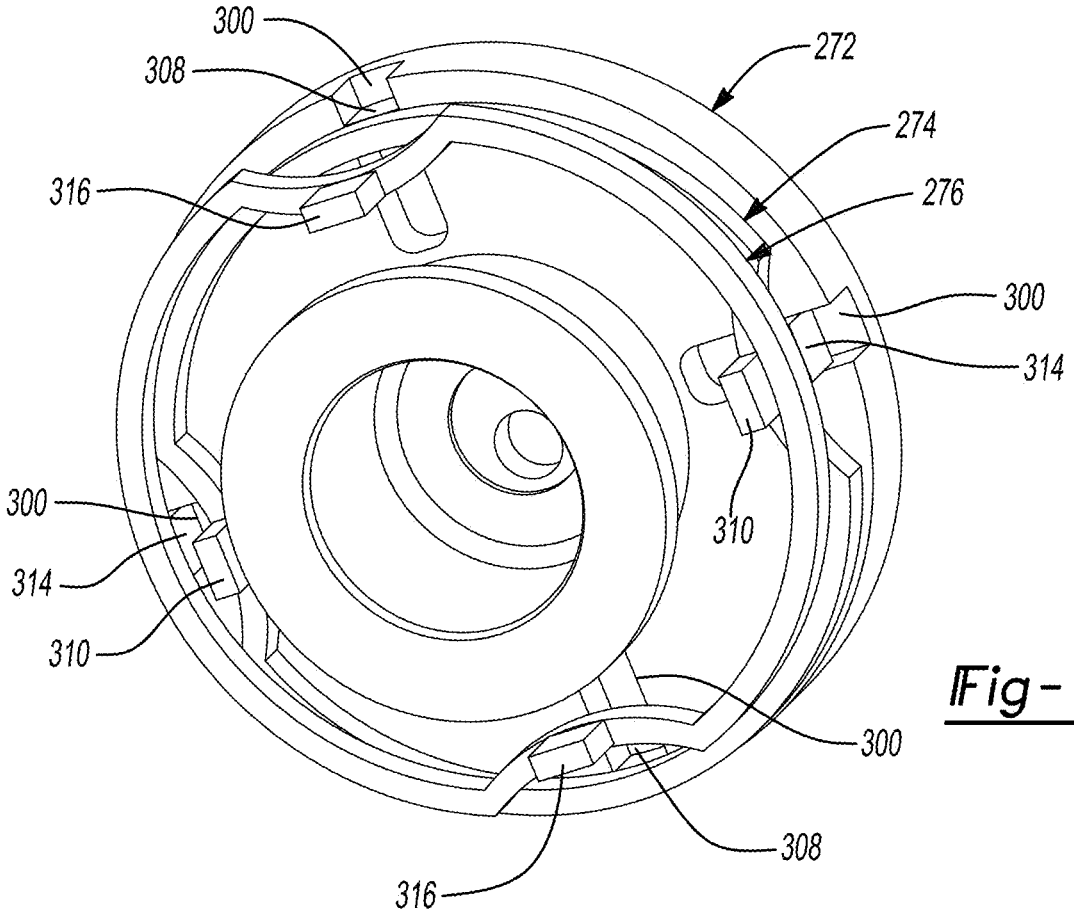
FIG. 17 is a perspective view of a scroll member and Oldham couplings of the compression mechanism of FIG. 15.
Figure 18:
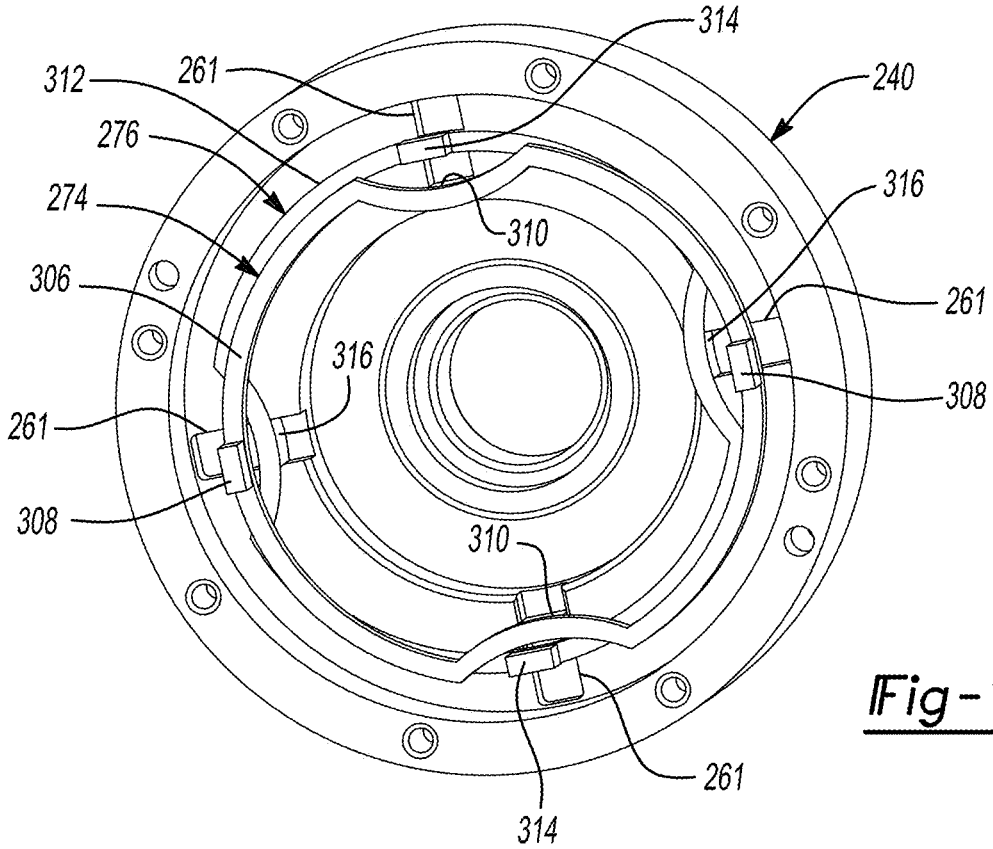
FIG. 18 is a perspective view of a bearing support member and the Oldham couplings.
Figure 19:
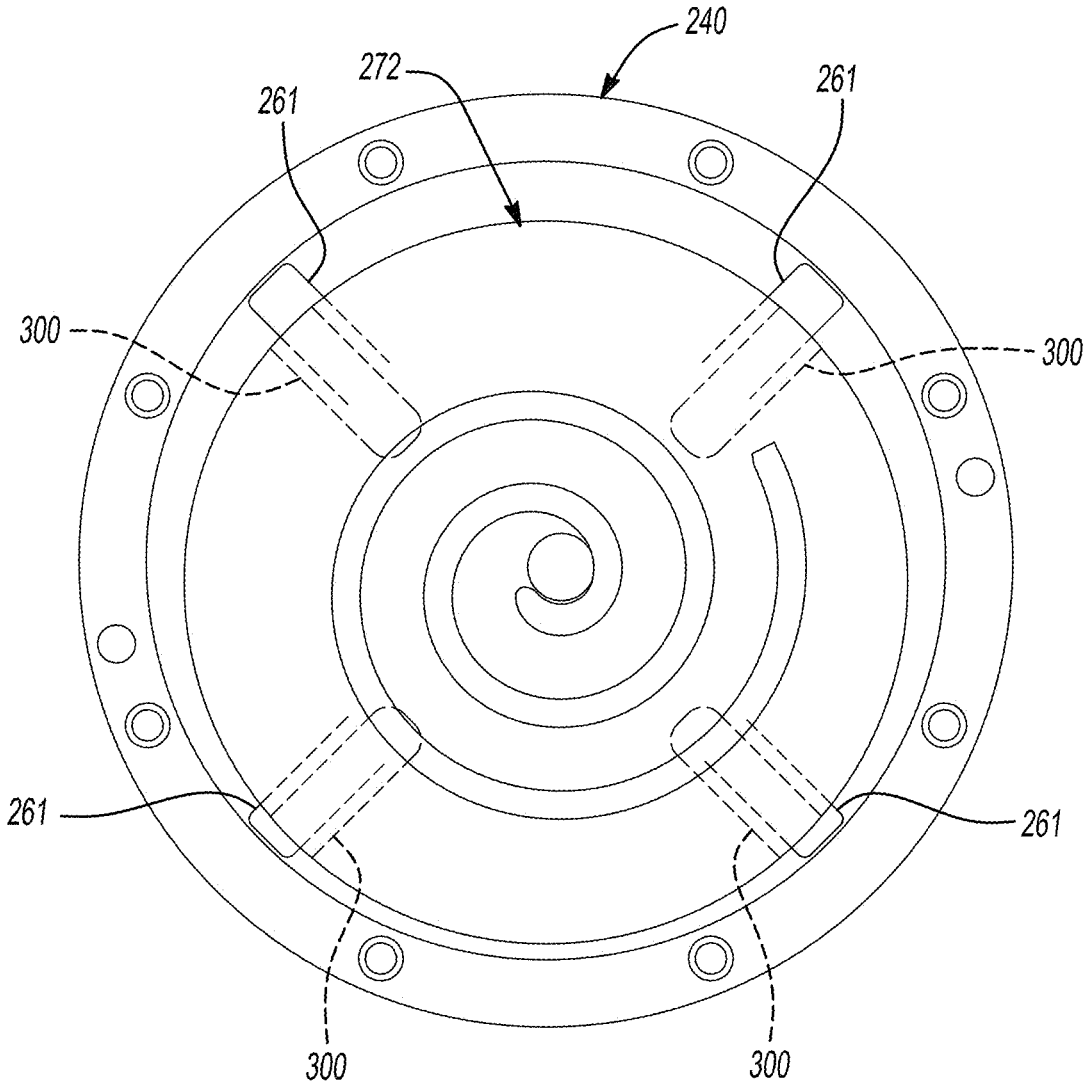
FIG. 19 is a plan view of the bearing support member and scroll member of FIG. 15.

As shown in FIGS. 4-6, the keys 108, 112 of the Oldham couplings 74, 76 are received within the slots 61, 100 of the second bearing support member 40 and the second scroll member 72. That is, a first portion of each key 108 of the first Oldham coupling 74 is received within a corresponding slot 61 of the second bearing support member 40 and a second portion of each key 108 of the first Oldham coupling 74 is received within a corresponding slot 100 of the second scroll member 72. Similarly, a first portion of each key 112 of the second Oldham coupling 76 is received within a corresponding slot 61 of the second bearing support member 40 and a second portion of each key 112 of the second Oldham coupling 76 is received within a corresponding slot 100 of the second scroll member 72. The keys 108, 112 are slidable within the slots 61, 100 along the lengths L of the slots 61, 100.

As shown in FIG. 6, a first one of the keys 108 is slidably received in a first one of the slots 61 and a first one of the slots 100. The first one of the slots 61 and the first one of the slots 100 are perpendicular to each other. A second one of the keys 108 is slidably received in a second one of the slots 61 and a second one of the slots 100. The second one of the slots 61 and the second one of the slots 100 are perpendicular to each other. A first one of the keys 112 is slidably received in a third one of the slots 61 and a third one of the slots 100. The third one of the slots 61 and the third one of the slots 100 are perpendicular to each other. A second one of the keys 112 is slidably received in a fourth one of the slots 61 and a fourth one of the slots 100. The fourth one of the slots 61 and the fourth one of the slots 100 are perpendicular to each other. Accordingly, during operation of the compressor 10, rotation of a center of gravity CG1 of the first Oldham coupling 74 is out of phase with rotation of a center of gravity CG2 of the second Oldham coupling 76, and therefore, inertial forces of the Oldham couplings 74, 76 cancel each other. That is, as shown in FIGS. 7-14, the center of gravity CG1 of the first Oldham coupling 74 is 180 degrees apart from the center of gravity CG2 of the second Oldham coupling 76 during operation of the compressor 10.

As shown in FIGS. 7-14, during operation of the compressor 10, the centers of gravity CG1, CG2 of the Oldham couplings 74, 76 move along a circular path P. The diameter of the circular path P is equal to the offset distance between the centers of rotation (i.e., the offset distance between the first and second rotational axes A1, A2) of the first and second scroll members 70, 72. The centers of gravity CG1, CG2 of the Oldham couplings 74, 76 rotate (along circular path P) at a rotational speed that is double (i.e., two times greater than) a rotational speed of the scroll members 70, 72 (note that the scrolls 70, 72 have rotated 45 degrees from FIG. 7 to FIG. 8 while the centers of gravity CG1, CG2 have rotated 90 degrees from FIG. 7 to FIG. 8). FIGS. 7-14 depict various positions of the scrolls 70, 72 and centers of gravity CG1, CG2 spanning one full rotation (360 degrees) of the scrolls 70, 72 and two full rotations (720 degrees) of the centers of gravity CG1, CG2.

Because rotation of the center of gravity CG1 of the first Oldham coupling 74 is out of phase with rotation of the center of gravity CG2 of the second Oldham coupling 76, inertial forces of the Oldham couplings 74, 76 cancel each other. This reduces or eliminates rotational unbalance in the compressor 10, thereby reducing noise and vibration during operation of the compressor 10. The configuration of the Oldham couplings 74, 76 and slots 61, 100 described above also allows for radial compliance of the scrolls 70, 72, which improves efficiency of the compressor 10 and reduces vibration.

With reference to FIGS. 15-19, an alternative first bearing housing 214 and alternative compression mechanism 218 are provided. The first bearing housing 214 and compression mechanism 218 can be incorporated into the compressor 10 instead of the first bearing housing 14 and compression mechanism 18 described above. The structure and function of the first bearing housing 214 and compression mechanism 218 can be similar or identical to that of the first bearing housing 14 and compression mechanism 18 described above, apart from differences described below and/or shown in the figures. Therefore, similar features will not be described again in detail.

Like the first bearing housing 14, the first bearing housing 214 may include a first bearing support member 238 and a second bearing support member 240. The first bearing support member 238 may be identical to the first bearing support member 38 described above. The second bearing support member 240 may be identical to the second bearing support member 40 described above, except slots 261 of the second bearing support member 240 are oriented differently than the slots 61 described above. Like the slots 61, the slots 261 are arranged in a circular pattern and are spaced approximately 90 degrees apart from each other. However, unlike the slots 61, the slots 261 that are 180 degrees apart are aligned with each other such that a longitudinal axis extending along a length of one slot 261 will also extend along the length of the slot 261 that is spaced 180 degrees apart.

The compression mechanism 218 may include a driveshaft 268, a first scroll member 270, a second scroll member 272, a first Oldham coupling 274, and a second Oldham coupling 276. The driveshaft 268 and first scroll member 270 may be similar or identical to the driveshaft 68 and first scroll member 70 described above. The second scroll member 272 may be identical to the second scroll member 72 described above, except slots 300 of the second scroll member 272 are oriented differently than the slots 100 described above. Like the slots 100, the slots 300 are arranged in a circular pattern and are spaced approximately 90 degrees apart from each other. However, unlike the slots 100, the slots 300 that are 180 degrees apart are aligned with each other such that a longitudinal axis extending along a length of one slot 300 will also extend along the length of another one of the slots 300 that is spaced 180 degrees apart.

The first Oldham coupling 274 may include a generally annular body 306, a first pair of keys 308, and a second pair of keys 310. The first keys 308 are protrusions that extend from a first side of the body 306 in a first axial direction. The first keys 308 are disposed approximately 180 degrees apart from each other. The second keys 310 are protrusions that extend from a second opposite side of the body 306 in a second opposite axial direction. The second keys 310 are disposed approximately 180 degrees apart from each other and approximately 90 degrees apart from adjacent first keys 308.

The second Oldham coupling 276 may include a generally annular body 312, a first pair of keys 314, and a second pair of keys 316. The first keys 314 are protrusions that extend from a first side of the body 312 in a first axial direction. The first keys 314 are disposed approximately 180 degrees apart from each other. The second keys 316 are protrusions that extend from a second opposite side of the body 312 in a second opposite axial direction. The second keys 316 are disposed approximately 180 degrees apart from each other and approximately 90 degrees apart from adjacent first keys 314.

The first keys 308 of the first Oldham coupling 274 are slidably received in a first pair of the slots 300 of the second scroll member 272, and the second keys 310 of the first Oldham coupling 274 are slidably received in a first pair of the slots 261 of the second bearing support member 240. The first keys 314 of the second Oldham coupling 276 are slidably received in a second pair of the slots 300 of the second scroll member 272, and the second keys 316 of the second Oldham coupling 276 are slidably received in a second pair of the slots 261 of the second bearing support member 240.

During operation of the compressor 10, rotation of a center of gravity of the first Oldham coupling 274 is out of phase with rotation of a center of gravity of the second Oldham coupling 276, and therefore, inertial forces of the Oldham couplings 274, 276 cancel each other. As described above, during operation of the compressor 10, the centers of gravity of the Oldham couplings 274, 276 move along a circular path. The diameter of the circular path is equal to the offset distance between the centers of rotation (i.e., the offset distance between the first and second rotational axes A1, A2) of the first and second scroll members 270, 272. The centers of gravity of the Oldham couplings 274, 276 rotate (along circular path) at a rotational speed that is double (i.e., two times greater than) a rotational speed of the scroll members 270, 272.

Because rotation of the center of gravity of the first Oldham coupling 274 is out of phase with rotation of the center of gravity of the second Oldham coupling 276, inertial forces of the Oldham couplings 274, 276 cancel each other. This reduces or eliminates rotational unbalance in the compressor 10, thereby reducing noise and vibration during operation of the compressor 10. The configuration of the Oldham couplings 274, 276 and slots 261, 300 described above also allows for radial compliance of the scrolls 270, 272, which improves efficiency of the compressor 10 and reduces vibration.

While the Oldham couplings 74, 76, 274, 276 are described above as being slidably engaged with the second scroll member 72, 272 and the second bearing support member 40, 240, in some configurations, the Oldham couplings 74, 76, 274, 276 may be slidably engaged with the first and second scroll members 70, 72, 270, 272.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell assembly;

a first scroll member disposed within the shell assembly;

a second scroll member disposed within the shell assembly and cooperating with the first scroll member to define compression pockets;

a driveshaft coupled to the first scroll member and configured to rotate the first scroll member relative to the shell assembly;

a first bearing defining a first rotational axis about which the driveshaft and the first scroll member rotate;

a second bearing spaced apart from the first bearing and supporting the second scroll member for rotation about a second rotational axis that is offset from the first rotational axis;

a first Oldham coupling including a first body and a plurality of first keys extending from the first body, the first keys slidably engaging first slots formed in the second scroll member; and a second Oldham coupling that is separate and distinct from the first Oldham coupling, the second Oldham coupling including a second body and a plurality of second keys extending from the second body, the second keys slidably engaging second slots formed in a surface of a bearing support member that rotates about the first rotational axis.

2. The compressor of claim 1, wherein during operation of the compressor, rotation of a center of gravity of the first Oldham coupling is out of phase with rotation of a center of gravity of the second Oldham coupling.

3. The compressor of claim 2, wherein the centers of gravity of the first and second Oldham couplings rotate at a rotational speed that is greater than a rotational speed of the first and second scroll members.

4. The compressor of claim 1, wherein the surface in which the second slots are formed is an axially facing surface of the bearing support member, and wherein the bearing support member is rotationally fixed relative to the first scroll member.

5. The compressor of claim 4, wherein:

the first and second bodies of the first and second Oldham couplings are annular bodies that extend around a hub of the second scroll member, the hub extends from a first side of an end plate of the second scroll member, and a spiral wrap extends from a second side of the end plate of the second scroll member.

6. The compressor of claim 1, wherein the first keys of the first Oldham coupling extend from the first body in first and second opposite directions, and wherein the second keys of the second Oldham coupling extend from the second body in first and second opposite directions.

7. The compressor of claim 6, wherein the first keys are disposed 180 degrees apart from each other, and wherein the second keys are disposed 180 degrees apart from each other.

8. The compressor of claim 1, wherein the first Oldham coupling includes third keys extending from the first body, and wherein the second Oldham coupling includes fourth keys extending from the second body.

9. The compressor of claim 8, wherein:

the first keys of the first Oldham coupling extend from the first body in a first direction, the third keys of the first Oldham coupling extend from the first body in a second direction that is opposite the first direction, the second keys of the second Oldham coupling extend from the second body in the second direction, and the fourth keys of the second Oldham coupling extend from the second body in the first direction.

10. The compressor of claim 9, wherein:

the first keys are disposed 180 degrees apart from each other, the second keys are disposed 180 degrees apart from each other, the third keys are disposed 180 degrees apart from each other, and the fourth keys are disposed 180 degrees apart from each other.

11. A compressor comprising:

a shell assembly;

a first bearing support member fixed relative to the shell assembly and including a first cylindrical surface and a second cylindrical surface that is eccentric relative to the first cylindrical surface;

a first scroll member rotatable relative to the first bearing support member about a first rotational axis defined by the first cylindrical surface;

a second scroll member cooperating with the first scroll member to define compression pockets, the second scroll member is rotatable relative to the first bearing support member about a second rotational axis defined by the second cylindrical surface;

a first Oldham coupling including a first body and a plurality of first keys extending from the first body, the first keys slidably engaging first slots formed in the second scroll member; and a second Oldham coupling that is separate and distinct from the first Oldham coupling, the second Oldham coupling including a second body and a plurality of second keys extending from the second body, the second keys slidably engaging second slots formed in a surface of a second bearing support member that rotates about the first rotational axis.

12. The compressor of claim 11, wherein during operation of the compressor, rotation of a center of gravity of the first Oldham coupling is out of phase with rotation of a center of gravity of the second Oldham coupling.

13. The compressor of claim 12, wherein the centers of gravity of the first and second Oldham couplings rotate at a rotational speed that is greater than a rotational speed of the first and second scroll members.

14. The compressor of claim 11, wherein:

the surface in which the second slots are formed is an axially facing surface of the second bearing support member, the second bearing support member is rotationally fixed relative to the first scroll member, the compressor includes a first bearing and a second bearing, the first bearing is attached to the second bearing support member and the first cylindrical surface of the first bearing support member, and the second bearing surrounds the second cylindrical surface of the first bearing support member and is disposed within a cavity of the second bearing support member.

15. The compressor of claim 14, wherein:

the first and second bodies of the first and second Oldham couplings are annular bodies that extend around a hub of the second scroll member, the hub extends from a first side of an end plate of the second scroll member, and a spiral wrap extends from a second side of the end plate of the second scroll member.

16. The compressor of claim 11, wherein the first keys of the first Oldham coupling extend from the first body in first and second opposite directions, and wherein the second keys of the second Oldham coupling extend from the second body in first and second opposite directions.

17. The compressor of claim 16, wherein the first keys are disposed 180 degrees apart from each other, and wherein the second keys are disposed 180 degrees apart from each other.

18. The compressor of claim 11, wherein the first Oldham coupling includes third keys extending from the first body, and wherein the second Oldham coupling includes fourth keys extending from the second body.

19. The compressor of claim 18, wherein:

the first keys of the first Oldham coupling extend from the first body in a first direction, the third keys of the first Oldham coupling extend from the first body in a second direction that is opposite the first direction, the second keys of the second Oldham coupling extend from the second body in the second direction, and the fourth keys of the second Oldham coupling extend from the second body in the first direction.

20. The compressor of claim 19, wherein:

the first keys are disposed 180 degrees apart from each other, the second keys are disposed 180 degrees apart from each other, the third keys are disposed 180 degrees apart from each other, and the fourth keys are disposed 180 degrees apart from each other.

* * * * *